United States Patent [19]

Shimp

[11] Patent Number: 4,639,701

[45] Date of Patent: Jan. 27, 1987

[54] CIRCUIT BREAKER WITH INTERFACE FLUX SHUNT TRIP

[75] Inventor: Alan B. Shimp, Monroeville Boro, Pa.

[73] Assignee: Westinghouse Electric Corp., Pittsburgh, Pa.

[21] Appl. No.: 771,377

[22] Filed: Aug. 30, 1985

[51] Int. Cl.[4] ..... H01H 73/02; H01H 75/00; H01H 77/00

[52] U.S. Cl. ..... 335/21; 335/22; 335/35; 335/173; 335/166

[58] Field of Search ..... 335/21, 22, 23, 24, 335/25, 35, 173, 174, 176, 166

[56] References Cited

U.S. PATENT DOCUMENTS

| | | | |
|---|---|---|---|
| 2,360,922 | 4/1939 | Wilckens | 335/202 |
| 3,079,479 | 1/1959 | Schwartz et al. | 335/174 |
| 3,772,620 | 11/1973 | Harris | 335/190 |
| 3,808,567 | 4/1974 | Maier | 335/167 |
| 4,001,742 | 1/1977 | Jencks et al. | 335/173 |

*Primary Examiner*—E. A. Goldberg
*Assistant Examiner*—Lincoln D. Donovan
*Attorney, Agent, or Firm*—L. P. Johns

[57] ABSTRACT

A circuit breaker characterized by a circuit breaker structure having separable contacts and a releasable mechanism which mechanism is retained in untripped position by a latch including a rotatable trip bar. A solenoid, that is operable automatically in response to overload current conditions, is located adjacent to the trip bar and has a plunger movable parallel to the axis of the trip bar. A lever is disposed between the plunger and the trip bar to translate longitudinal motion into rotational trip bar motion.

4 Claims, 11 Drawing Figures

FIG. 2
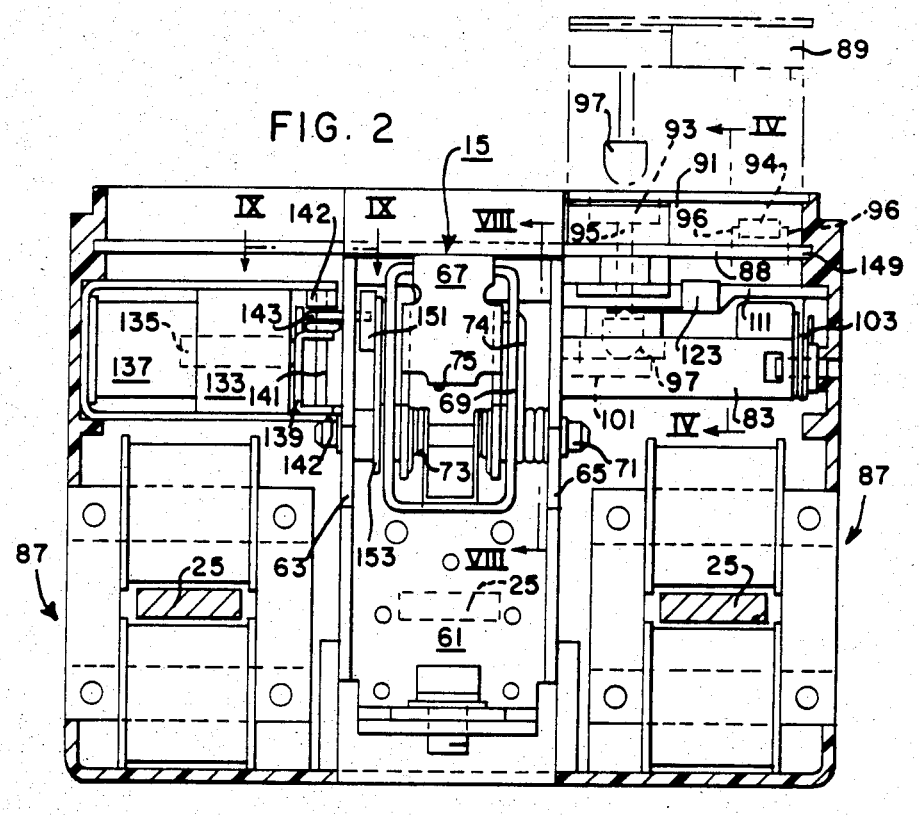
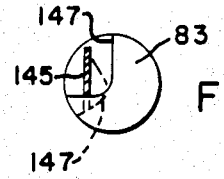
FIG. 11
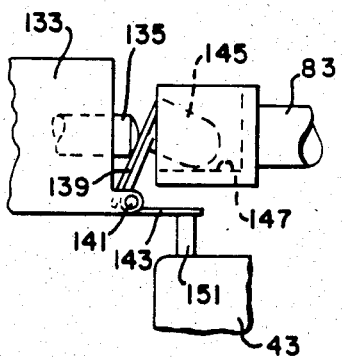
FIG. 9
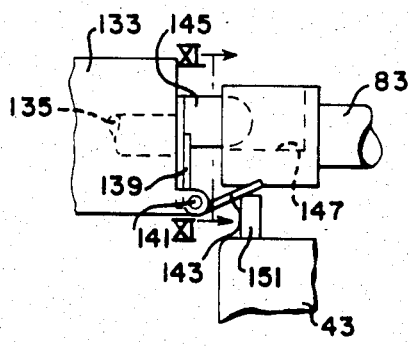
FIG. 10

CIRCUIT BREAKER WITH INTERFACE FLUX SHUNT TRIP

CROSS REFERENCE TO RELATED APPLICATION

Cross reference is made to the copending application of Alan B. Shimp and William E. Beatty, Ser. No. 771,376, filed Aug. 30, 1985, which application is filed concurrently herewith.

BACKGROUND OF THE INVENTION

1. Field of the Invention

This invention pertains to circuit breakers of the type comprising latched stored energy mechanism releasable to effect tripping and, more particularly, it pertains to a flux shunt trip means automatically operable in response to overload conditions.

2. Description of the Prior Art

In the past, circuit breakers have been provided with trip units that were devoid of integral flux shunt trip mechanism. It was customary to provide a separate flux shunt trip mechanism within the circuit breaker but external of the trip unit housing. Inasmuch as a trip unit was used in different types of circuit breakers, it was necessary to provide a variety of types of flux shunt trip mechanisms to accommodate the different types of circuit breakers. Moreover, because of mechanical restrictions within the housing of the trip unit, space was limited for providing a flux shunt trip mechanism within the trip unit housing.

SUMMARY OF THE INVENTION

A circuit breaker comprising a housing, a circuit breaker structure supported in the housing and having a pair of contacts operable to open and close an electric circuit, a releasable mechanism, manually operable means operable when the releasable mechanism is in a latched position to open and close the contacts, trip means including an electro-mechanical means operable automatically in response to overload current conditions above a predetermined value to release the releasable mechanism whereupon the releasable mechanism automatically moves from the latched position to a tripped position to open the contacts, the manually operable means being operable to move the releasable mechanism from the tripped position to the latched position after release of the releasable mechanism, latch means operable between the latching and unlatching positions and biased in the former position to latch the releasable mechanism, the trip means also including a trip bar rotatably mounted in response to operation of an electromechanical means for unlatching the latch means and being biased in the untripped position, and the electromechanical means including a plunger which is operable against a lever to transfer the longitudinal movement of the plunger into rotational movement of the trip bar.

The advantage of the device of this invention is that the longitudinal movement of a plunger of an electromechanical device is translated into rotational movement of a trip bar for tripping a circuit breaker.

BRIEF DESCRIPTION OF THE DRAWINGS

FIG. 2 is a vertical sectional view taken on the line II—II of FIG. 1;

FIG. 9 is a horizontal sectional view taken on the line IX—IX of FIG. 2;

FIG. 10 is a view similar to FIG. 9 with parts in alternate positions; and FIG. 11 is an end view taken on the line XI—XI of FIG. 10.

DESCRIPTION OF THE PREFERRED EMBODIMENT

Figure 1:
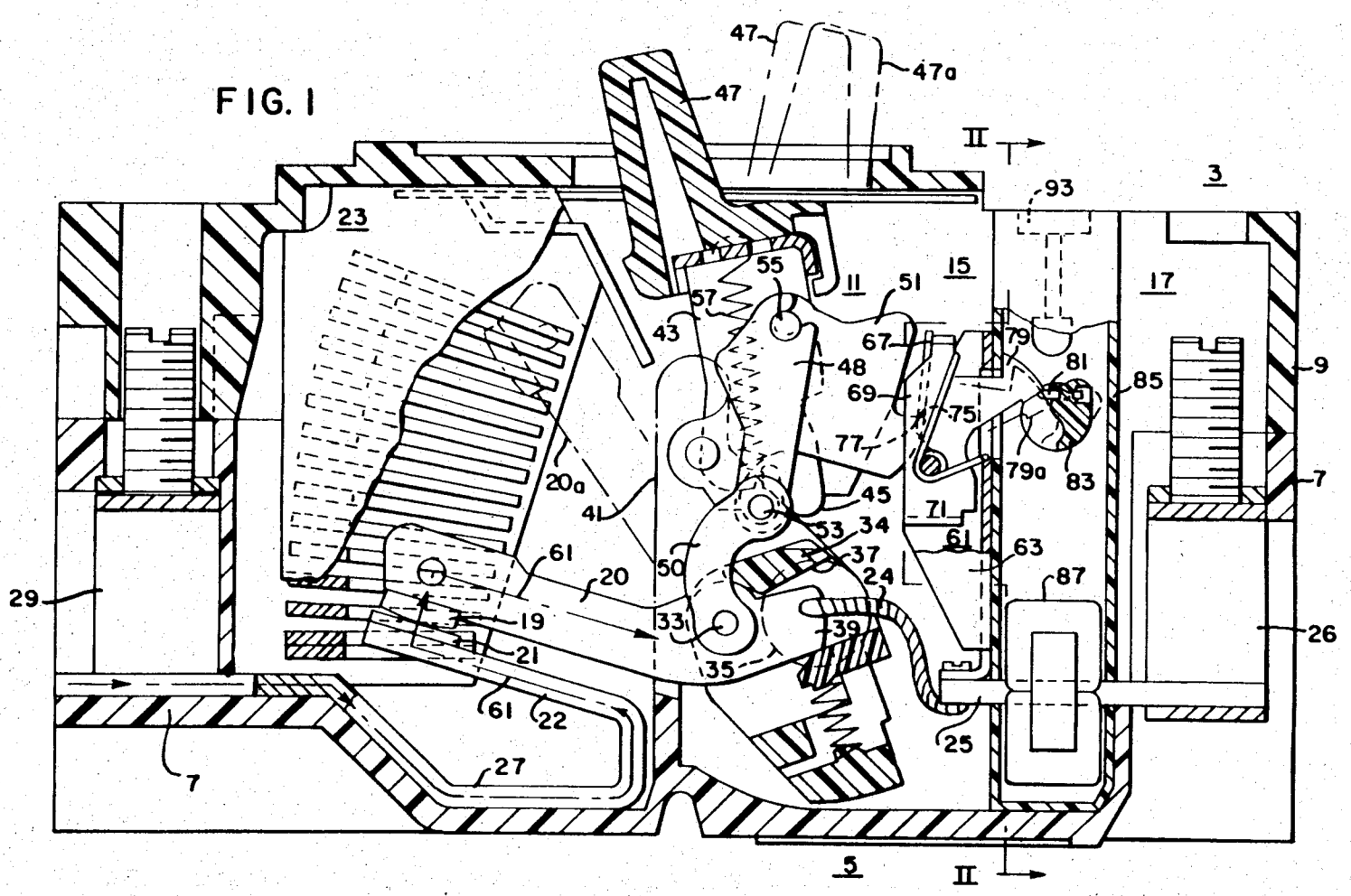
FIG. 1 is a vertical sectional view, with parts broken away, through the center pole unit of a three-pole circuit breaker.

A three-pole circuit breaker, generally indicated at 3 in FIG. 1, comprises an insulating housing 5 including a base 7 and a cover 9 which is secured to the base in a conventional manner such as by screws (not shown). Although the principal of this invention is applicable to a single pole circuit breaker, it is usually applicable to a multi-pole unit for which reason the housing 3 comprises insulating barriers separating the housing into three adjacent side-by-side pole unit compartments in a manner well known in the art.

Within the housing a circuit breaker mechanism 11 is mounted within the center pole unit of the housing and comprises a single operating mechansim and a latch mechanism 15. The circuit breaker mechanism 11 also comprises a high speed electromagnetic trip device 17.

Each pole of the circuit breaker includes a pair of separable contacts 19 and 21, attached to upper and lower contact arms 20 and 22, respectively. An arc extinguishing unit or arc chute 23 is provided in each pole unit. The upper contact 19 is electrically connected, through the upper contact arm 20 (constructed of conducting material), to a shunt 24 which is connected through a conducting strip 25 and through the trip device 17 to a terminal 26.

The lower contact 21 is connected through the lower contact arm 22 and a conducting strip 27 to a terminal 29. With the circuit breaker 3 in the closed position, an electrical circuit thus exists from the terminal 29 through the several items 27, 22, 21, 19, 20, 24, 25, to the terminal 26.

The contact arm 20 is pivotally connected at pivot pin 33 to a rotatable carriage 34 which is fixedly secured to an insulating rotatable tie bar 35. The carriage 34 includes a slot or pocket 37 in which an end portion 39 of the arm 20 is mounted on the pivot pin 33. The arm 20 and the carriage 34 rotate as a unit with the tie bar 35 during normal current conditions through the circuit breaker.

The single operating mechanism 11 is positioned in the center pole unit of the three-pole circuit breaker and is supported on and between a pair of rigid support plates 41 (one of which is shown) that are fixedly secured in the base 7 in the center pole unit of the breaker. An inverted U-shaped operating lever 43 is pivotally supported on the spaced plates 41 with the ends of the legs of the lever positioned in U-shaped notches 45 of the plates. The operating lever 43 includes a handle 47 of molded electrically insulating material.

the contact arm 20 for the center pole unit is operatively connected by means of a toggle comprising an upper toggle link 48 and lower toggle link 50 to a releasable cradle member 51. The toggle links are pivotally interconnected by means of a knee pivot pin 53. The lower toggle link 50 is pivotally connected to the carriage 34 of the center pole unit by the pin 33 and the upper toggle link is pivotally connected to the releasable cradle member 51 by a pivot pin 55. Overcenter operating springs 57 are connected under tension between the pivot knee pin 53 and the bight portion of the operating lever 43.

The contacts 19, 21 are manually opened by movement of the handle 47 from the ON position (FIG. 1) to an OFF position to the right of that shown in FIG. 1. Movement of the handle 47 to the right (to the OFF position) carries the line of action of the overcenter operating springs 57 to the right, causing collapse of the toggle links 48, 50 and to rotate the tie bar 35 in a clockwise direction to simultaneously move the contact arm 20 of the three pole units to the open position and thereby opening the contacts of the three pole units. The contact arm 20 is then in the broken line position 20*a* (FIG. 1).

The contacts are manually closed by reverse movement of the handle to the left which movement moves the line of action of the overcenter springs 57 to the left to move the toggle links 48, 50 to the position shown in FIG. 1. This movement rotates the tie bar 35 in a counterclockwise direction to move the contact arms 20 of the three pole units to the closed position.

The releasable cradle member 51 is latched in the position shown in FIG. 1 by means of the latch mechanism 15 which is a lever actuated by the trip device 17. The trip device 17 is capable of detecting both low level short circuit or overload current conditions and high level short circuit or fault current conditions. Upon the detection of any such condition the trip device 17 actuates the latch mechanism to initiate the trip operation of the circuit breaker mechanism 11.

The latch mechanism 15 (FIG. 2) comprises a U-shaped mounting frame 61 having spaced legs 63, 65, a latch lever 67, and a trip lever 69. Both levers 67, 69 are pivotally mounted on a pin 71 which is journaled in the legs 63, 65. A spring 73 biases the latch lever 67 clockwise against upper portions of the trip lever 69 which is biased counterclockwise by a spring 75.

Figure 8:
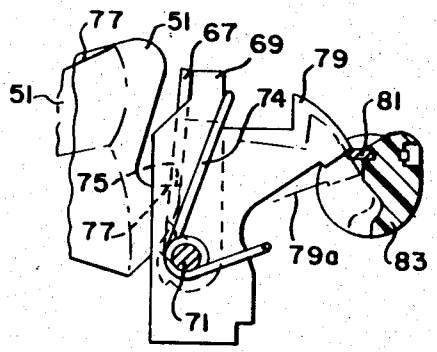
FIG. 8 is a fragmentary sectional view, taken on the line VIII—VIII of FIG. 2.

The latch lever 67 includes a surface 75 that engages a notch surface 77 of the cradle member 51 when the member is in the latched or untripped position (FIG. 1, 8). Because of the pressure applied to the circuit breaker mechanism 11 by the springs 57, the cradle member 51 remains in the latched position with the surfaces 75, 77 engaged. The latched position of the releasable member 51 is sustained by backup pressure applied by the upper end of the trip lever 69 against the upper end of the latch lever 67 which in turn is reinforced by a flange 79 which is held in place against clockwise rotation about the pin 71 by a detent 81 on a trip bar 83 as set forth hereinbelow. Suffice it to say, when the trip bar 83 is rotated clockwise through a small arc the pressure of the springs 57 (FIG. 1) rotates the trip lever 69 clockwise to a broken line position 79*a*, thereby releasing the surface 77 from the surface 75 of the latch lever 67. Accordingly, the trip lever 69 moves to the broken line position 79*a* (FIG. 8) which permits the torsion spring 74 to return the trip lever 69 as well as the latch lever 67 counterclockwise to their original positions.

After being tripped the circuit breaker mechanism 11 may be reset to the untripped position by moving the handle 47 clockwise to position 47*a* and return the surface 77 to a latched position under the surface 75 of the latch lever 67 which in turn yields slightly clockwise against the torsion spring 73 which in turn returns the latch lever to the latched position.

The electromagnetic trip device 17 is contained within an insulating box-like container 85 which is detachably mounted within the circuit breaker 3. It contains a current transformer 87 per pole, electronic circuit board 88, magnetic trip actuator 133, the trip bar 83, and an interlock assembly 89 (FIG. 2) which includes a replaceable rating plug 91, and a push-to-trip button 93. The interlock assembly 89 including the rating plug is detachably mounted for replacement by a similar rating plug of a different rating. Generally, the rating plug includes a resistor (FIG. 2) of a specific resistance for a desired rating. The resistor 94 is connected between connector pins 96 on the rating plug. When the plug is inserted into the unit, connector pins 96 make contact with matching receptacles in the circuit board 98, thereby calibrating the trip unit to a particular rating.

Figure 4:
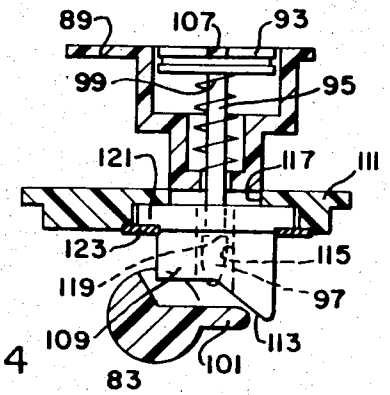
FIG. 4 is a vertical sectional view taken on the line IV—IV of FIG. 3.

When the circuit breaker is in the closed position and it is desired to manually trip the circuit breaker, the trip button 93 is used. The trip button is seated within the housing of the trip control assembly 89 and the button includes an elongated shaft 95 (FIGS. 4, 6) and an enlarged end portion 97 fixed to the lower end of the shaft. The shaft extends through a coil spring 99 in the housing for returning the button to the retracted position when it is released.

When the button 93 is depressed, the lower end strikes a projection 101 (FIG. 7) extending radially from the trip bar 83 and thereby rotates the trip bar clockwise to the trip position by moving the detent 81 (FIG. 8) from under the flange 79, thereby unlatching the cradle member 81 to open the contacts 19, 21.

When the trip button 93 is released, the coil spring 99 returns the button the the retracted position (FIG. 4) whereupon a torsion spring 103 (FIG. 2) rotates the trip bar 83 counterclockwise to the untripped position. In that position the circuit breaker may be reset by moving the handle 47 (FIG. 1) clockwise beyond the trip position shown in FIG. 1 to relatch the cradle member as shown in the solid line position of the member 51 in FIG. 8.

Figure 7:
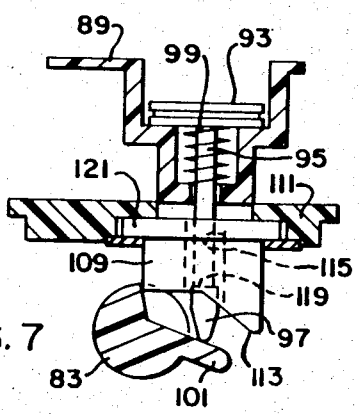
FIG. 7 is a sectional view showing the push button and trip bar in the tripped positions.
Figure 5:
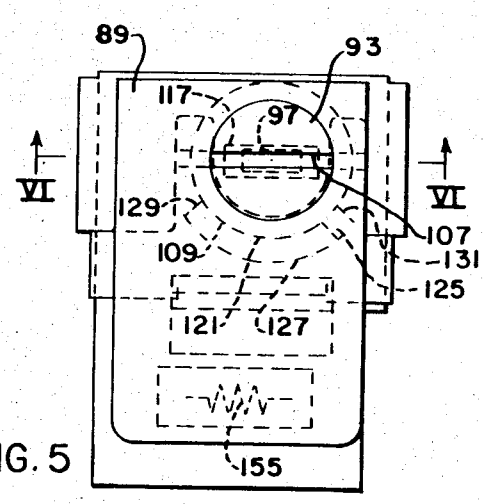
FIGS. 5 and 6 are views similar to FIGS. 3 and 4, respectively, with parts in alternate positions.

When it is necessary to replace the rating plug 91, the trip bar is turned to the trip position (FIG. 6) so that the circuit breaker contacts 19, 21 cannot be closed until a rating plug interlock is installed. For that purpose the trip button 93 is rotated, such as by inserting a screwdriver into a slot 107 in the top of the button. As shown in FIGS. 3–7 the trip button 93 functions with a cam 109 which is rotatably mounted in a cam mounting plate 111. The cam, includes a cam surface 113 and a bore 115. The bore has a non-circular cross-section which is preferably rectangular and accommodates movement of the enlarged end portion 97 having a similar and slightly smaller cros-section. Thus the enlarged end portion 97 is slidable through the bore 115, such as when the trip button 93 is advanced to trip the trip bar 83 (FIG. 7). When the trip button 93 is used to trip the trip bar, the cam 109 is in the position shown in FIGS. 4 and 7 with the cam surface 113 out of contact with the projection 101. When, however, the trip button 93 is rotated, the enlarged end portion 97, being within the cam bore 115, rotates the cam until the cam surface 113 is in the position shown in FIG. 6 with the lower end of the cam in contact with the projection 101, thereby preventing return of the trip bar 83 to the untripped position. As a result the cradle member 51 cannot be reset and the contacts 19, 21 are in the open position.

Figure 6:
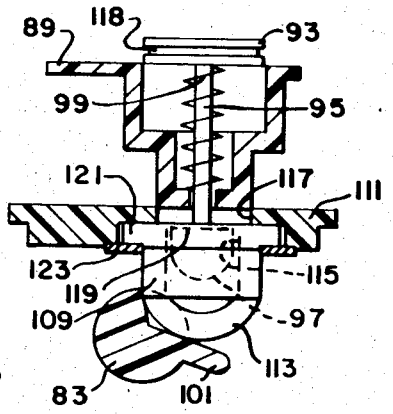
Figure 3:
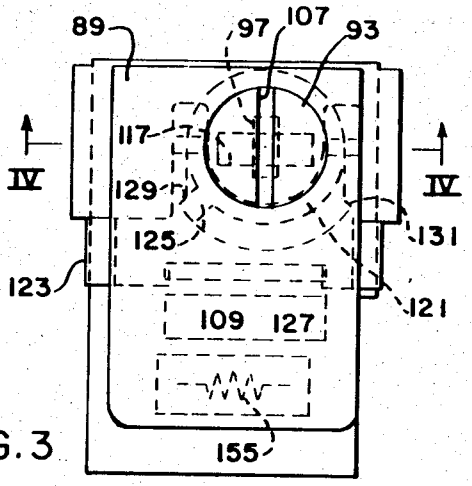
FIG. 3 is a fragmentary horizontal view taken on the line III—III of FIG. 1.

With the cam 109 in the position shown in FIG. 6, the cam bore 15 registers with a similar rectangular opening 117 in the cam mounting plate 111 so that the enlarged end portion 97 may be removed from the cam and through the opening 117 when it is necessary to remove the trip control assembly 89 for removal and replacement of the associated rating plug interlock 91. The enlarged end portion 97 includes a pair of similar oppositely extending shoulders 119. So long as the cam 109 is in the positions shown in FIGS. 4 and 7, the shoulders 119 are unaligned with the opening 117 in the cam mounting plate 111 so that the enlarged end portion 97 cannot be removed from the position shown.

On the other hand, when the button 93 is turned in the position shown in FIG. 6, the enlarged end portion 97 is aligned with the opening 117 (FIG. 5) and spring 99 causes the button to protrude above the surface of the rating plug 89. With the button protruding, a user can grasp the button by means of a groove 118 to lift the rating plug from the trip unit. When the button is rotated to the position of FIG. 4, it does not protrude above the rating plug surface and it is therefore impossible to grasp the button and lift the trip unit from the rotating plug.

As shown in FIGS. 3–7 the cam 109 includes a peripheral flange 121 which is seated within a recess of the cam mounting plate 111 where it is secured by a retaining clip 123. A projection 125 (Figs: 3, 5) extends outwardly from the flange 121 and is movable in a 90° arcuate portion 127 of the recess which arcuate portion includes opposite end surfaces 129, 131.

Upon the occurrence of overload current conditions a magnetic trip actuator 133 (FIGS. 2, 9, 10) automatically unlatches the latch mechanism 15 to release the cradle member 51. The actuator 133, being an electromagnetic device, comprises an armature plunger 135 that is maintained in the inoperative position (FIG. 2, 10) by magnetic means 137 (FIG. 1). The armature plunger 135 functions in conjunction with a lever 139 that is pivotally mounted on a pivot pin 141 having opposite ends seated in an associated frame member. A torsion spring 143 is also mounted upon the pivot pin 141 for retracting the plunger 135 to the retracted position. The lever 139 includes a flange 145. When the armature plunger 135 is actuated to the extended position (FIG. 9), the lever 139 is rotated clockwise to cause the flange 145 to bear against a cam surface 147 on the end of the trip bar 83 (FIG. 11), thereby rotating the bar against the pressure of the torsion spring 103 (FIG. 2) to trip the circuit breaker mechanism 11.

Upon the occurrence of an overload in any of the pole units, the associated current transformer 87 senses the overload and operates through the static circuit board 98 (FIG. 2) to pulse the magnetic trip actuator 133 to thereby force the plunger 135 against the lever 139. It is well known that with this type of electromagnetic actuator it is necessary to force the moving armature firmly to its seated position to ensure the device is reset. The use of the torsion spring 143 can deflect and thereby give some over travel to ensure that the plunger is firmly seated.

Subsequently, when the circuit breaker is reset by moving the handle 47 (FIG. 1) clockwise from the off position to the reset position 47a, the lever 43 moves against a link 151 which is mounted at the upper end of a lever 153 (FIG. 2) the lower end of which is pivotally mounted on the pivot pin 71. As a result (FIG. 9) the link 151 moves against the torsion spring 143 and moves it to the position shown in FIG. 10 to cause the lever 139 to move the armature plunger 135 into its retracted position.

In conclusion, the circuit breaker mechanism provides a device for translating axial motion of a flux shunt trip to rotational motion of a trip bar. Means are also provided for resetting the flux shunt trip by movement of the circuit breaker handle to the reset position.

What is claimed is:

1. A circuit breaker comprising:
a housing;
a circuit breaker structure supported in the housing;
the circuit breaker structure having a pair of contacts operable to open and close an electric circuit;
a releasable mechanism;
manually operable means manually operable when the releasable mechanism is in a latched position to open and close the contacts;
trip means including an electro-mechanical means operable automatically in response to overload current conditions above a predetermined value to release the releasable mechanism whereupon the releasable mechanism automatically moves from the latched position to a tripped position to open the contacts;
the manually operable means being operable to move the releasable mechanism from the tripped position to the latched position after release of the releasable mechanism;
latch means including a latch lever operable between latching and unlatching positions to latch the releasable mechanism;
the trip means also including a trip bar rotatably mounted on its longitudinal axis between latching and unlatching positions in response to operation of the electro-mechanical means for unlatching the latch lever and being biased in the untripped position; and
the electro-mechanical means being operable against a surface of the trip bar to rotate the bar to the tripped position and including a second lever movable by the electromechanical means against a surface of the trip bar to unlatch the latch lever.

2. The circuit breaker of claim 1 in which the electromechanical means includes a plunger operable against the second lever to translate the longitudinal motion of the plunger into rotational motion of the trip bar.

3. A circuit breaker comprising a pair of separable contacts operable to open and close an electric circuit;
a latched releasable member releasable to effect opening of the contacts;
latch means latching the releasable member and comprising a latch lever pivotally mounted for movement between latched and unlatched positions of the releasable member;
a trip bar, said trip bar being independent of and non-integral with the latch lever rotatably mounted on its longitudinal axis between latched and unlatched positions of the latch lever and biased in the latched position;

trip means including an electro-mechanical mechanism operable automatically in response to overload current conditions above a predetermined value to unlatch the trip bar;

the electro-mechanical mechanism including a plunger operable to rotate the trip bar to the unlatched position; and means for retracting the plunger from the trip bar.

4. The circuit breaker of claim 3 in which the trip bar comprises a cam surface and a lever is disposed between the plunger and the cam surface to cause rotation of the trip bar when the plunger moves the lever.

* * * * *